US011357335B2

(12) United States Patent
Ajamian

(10) Patent No.: US 11,357,335 B2
(45) Date of Patent: Jun. 14, 2022

(54) BED SHEET FASTENER

(71) Applicant: Arnaud Ajamian, North Salem, NY (US)

(72) Inventor: Arnaud Ajamian, North Salem, NY (US)

(73) Assignee: Arnaud Ajamian, North Salem, NY (US)

( * ) Notice: Subject to any disclaimer, the term of this patent is extended or adjusted under 35 U.S.C. 154(b) by 0 days.

(21) Appl. No.: 16/738,251

(22) Filed: Jan. 9, 2020

(65) Prior Publication Data

US 2020/0214464 A1 Jul. 9, 2020

Related U.S. Application Data

(60) Provisional application No. 62/790,230, filed on Jan. 9, 2019.

(51) Int. Cl.
*A47C 21/02* (2006.01)

(52) U.S. Cl.
CPC ..... *A47C 21/022* (2013.01); *A47C 21/028* (2013.01)

(58) Field of Classification Search
CPC ..... A47C 21/022; A47C 21/028; A47C 21/02; A47C 21/06; Y10T 24/23; A44D 2203/00; A47G 2009/004; A47G 9/04; A47G 2200/106
USPC ..... 24/72.5; 248/206.5, 309.4
See application file for complete search history.

(56) References Cited

U.S. PATENT DOCUMENTS 93,931 A * 8/1869 Wescott ..... H01F 7/0252 335/285
807,706 A * 12/1905 Allen ..... A47C 21/022 24/72.5
856,052 A * 6/1907 Grandjean ..... A47C 21/022 24/72.5
1,950,084 A * 3/1934 Halsey ..... A47C 21/022 24/72.5
1,982,998 A * 12/1934 Matchett ..... A47C 21/022 24/72.5
8,464,377 B1 * 6/2013 Carson ..... A47G 9/02 5/498
2008/0028524 A1 * 2/2008 Gilbert ..... A47D 15/008 5/498

(Continued)

FOREIGN PATENT DOCUMENTS

DE 2427902 A1 * 1/1976 ..... A47C 21/022
GB 2488549 A * 9/2012 ..... A47G 9/04

*Primary Examiner* — Jack W Lavinder
(74) *Attorney, Agent, or Firm* — Rimon PC

(57) ABSTRACT

The present application discloses a bedsheet fastening device for fastening bedsheet to a mattress and holding it in place. The device comprises magnets configured to hold the bedsheet to the mattress and prevent it from rumpling. In some embodiments, the device comprises a plurality sets of magnets with each set of magnets comprising a first piece of magnet and a second piece of magnet. The first piece of magnet is affixed to the mattress and the second piece of magnet can be attached to and removed from the first piece of magnet. The plurality sets of magnets are arranged on the mattress and can hold a bedsheet securely in place. The bedsheet can be removed by separating the first piece of magnet from the second piece in each set. In some embodiments, magnets are housed in a protective cover or a holder, for example, an insert or a panel.

11 Claims, 9 Drawing Sheets

(56) References Cited

U.S. PATENT DOCUMENTS

| | | | | |
|---|---|---|---|---|
| 2012/0233776 | A1* | 9/2012 | Agarwall | A47G 9/0238 5/496 |
| 2012/0233777 | A1* | 9/2012 | Hare | A47C 21/022 5/498 |
| 2017/0202361 | A1* | 7/2017 | White | F16B 2/10 |

* cited by examiner

BED SHEET FASTENER

FIELD OF INVENTION

The present disclosure relates to a device that can be used to hold a bedsheet in place and also make it more convenient to change bedsheet.

BACKGROUND

Conventional fitted bedsheets often use elastic bands to hold in place the bedsheet that is wrapped around the mattress. When not using elastic band, bedsheet is often folded and tucked under the mattress to prevent it from rumpling. Either way, the bedsheet is not securely fastened onto the mattress and can easily scrunch up and become out of place.

Several commercially available products are designed to hold a bedsheet in place and also make it easy to remove the bedsheet. For example, QuickZip and SheetLock are two products that are currently sold in stores. QuickZip addresses the inconvenience people face when changing their fitted bedsheet. SheetLock uses elastic bands to wrap the bedsheet at the two ends of the mattress. However, both products cannot be easily adapted to what users currently have, e.g., the size of the mattress and the bedsheets they own. QuickZip users must purchase entirely new QuickZip bedsheets. SheetLock users must purchase SheetLock products that match the size of their mattresses.

The present disclosure teaches a novel and inventive device that can be used on any size mattress and any bedsheet a user currently owns, and is also easy to install and remove.

SUMMARY

Accordingly, it is the objective of the present disclosure to teach a bedsheet fastener that can be used to hold a bedsheet in place and is firmly attached to a mattress.

In some embodiments, the bedsheet fastener comprises one or more sets of magnets. Each set of magnets comprises two pieces of magnets. The first piece of magnet is configured to be attached to a mattress. The second piece of magnet is attachable to and detachable from the first piece of magnet. A bedsheet can be held in between the two pieces of magnets. The one or more sets of magnets can be arranged on or around the mattress to firmly hold the bedsheet and prevent the bedsheet from rumpling.

In some embodiments, the first piece of magnet can be mechanically affixed to the mattress. In some embodiments, the first piece of magnet can be affixed to the mattress via chemically means. For example, the first piece of magnet can be glued to the mattress. Removable adhesive can be used to allow easy and clean removal when the bedsheet fastener needs to be taken off from the mattress.

In some embodiments, the first piece of magnet is placed in an insert that is affixed to the mattress. In one embodiment, the insert comprises a first panel and a base. The first panel is vertical and the base is horizontal. The first panel is connected to the base. The base can be placed underneath the mattress. The first piece of magnet is placed inside the vertical panel. In some embodiment, the second piece of magnet is placed in a second panel that comprises a handle for holding by hand. Because of the magnets, the second panel can be attached to or detached from the first panel of the insert by hand.

In some embodiments, the insert comprises a pane and a base. The pane is vertical and the base is horizontal. The pane is connected to the base. The base can be placed underneath the mattress. A first piece of magnet is placed in a first panel and the second piece of magnet is placed in a second panel. The first panel can be attached to the pane of the insert. The second panel can be attached to and detached from the first panel.

In some embodiments, an apparatus for fastening a bedsheet to a mattress is disclosed. The apparatus can be made, but not limited to, of any of the following materials, plastic, cardboard, wood, etc. The apparatus comprises an insert and an attachment panel. The insert comprises a vertical panel and a base. The vertical panel is configured to hold one or more pieces of magnets. The base is configured to be placed underneath the mattress. The attachment panel can be attached to the vertical panel via magnets to secure the bedsheet in between the attachment panel and the vertical panel. In one embodiment, the attachment panel and the vertical panel each have one or more hollow portions arranged at matching locations. Each hollow portion is used to hold a piece of magnet. In one embodiment, the attachment panel and the vertical panel have one or more inner pockets arranged at matching locations. Each inner pocket can hold a piece of magnet. In some embodiments, the attachment panel comprises a handle for holding by hand. In one embodiment, the insert may comprise a vertical pane and a horizontal base. A panel that contains magnets can be attached to or detached from the vertical pane.

In some embodiments, an apparatus for fastening a bedsheet to a mattress comprises an insert and an attachment panel. The insert comprises a vertical panel and a base. The base is configured to be placed underneath the mattress. The vertical panel is connected to the base. The attachment panel can be attached to the vertical panel via magnet to secure the bedsheet in between the attachment panel and the vertical panel. The attachment panel may be configured with a handle for holding by hand. In one embodiment, the vertical panel is made of metal and the attachment panel can hold one or more pieces of magnet. In another embodiment, the attachment panel is made of metal. The vertical panel can hold one or more pieces of magnet. In one embodiment, the vertical panel may comprise a vertical pane and a panel attached to the vertical pane. The panel contains the one or more pieces of magnet.

BRIEF DESCRIPTION OF THE DRAWINGS

These and other features of the present disclosure will become readily apparent upon further review of the following specification and drawings. In the drawings, like reference numerals designate corresponding parts throughout the views. Moreover, components in the drawings are not necessarily drawn to scale, the emphasis instead being placed upon clearly illustrating the principles of the present disclosure.

DETAILED DESCRIPTION

Embodiments of the disclosure are described more fully hereinafter with reference to the accompanying drawings, in which preferred embodiments of the disclosure are shown. The various embodiments of the disclosure may, however, be embodied in many different forms and should not be construed as limited to the embodiments set forth herein. Rather, these embodiments are provided so that this disclosure will be thorough and complete, and will fully convey the scope of the disclosure to those skilled in the art.

Figure 1A:
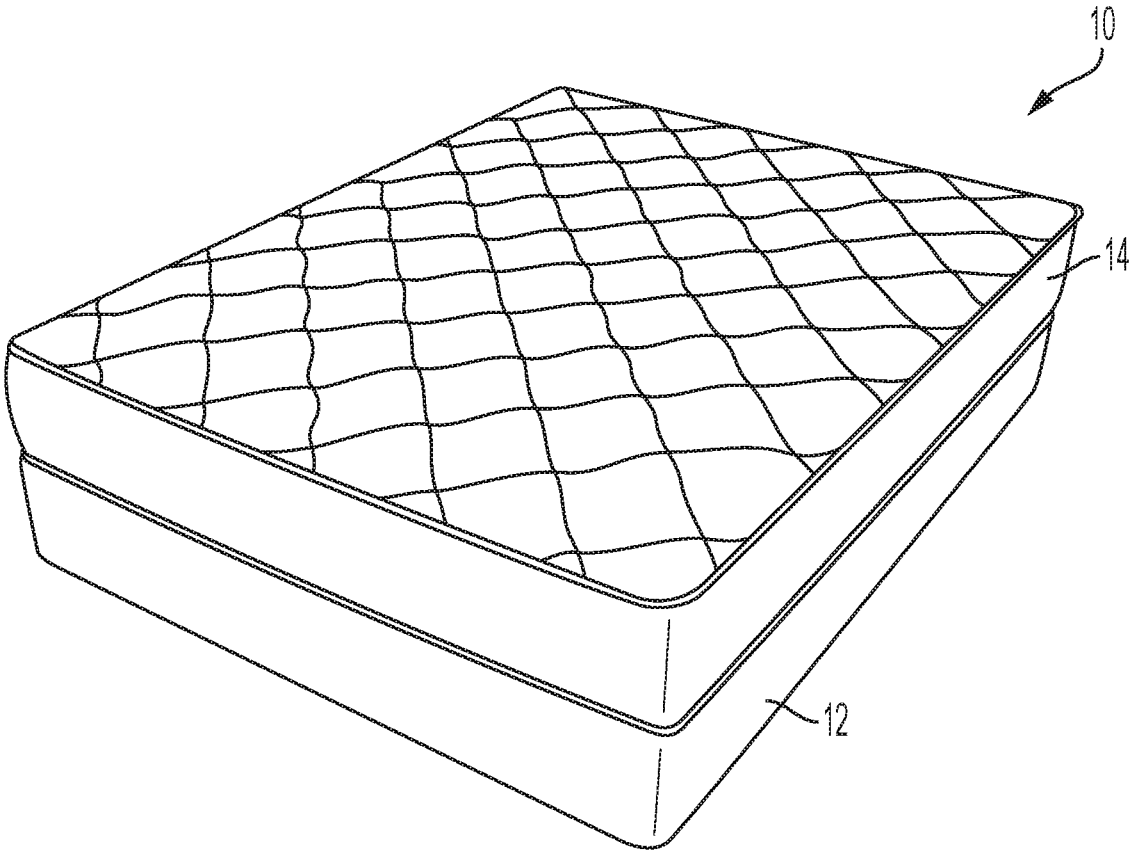
FIG. 1*a* is an illustration of a conventional mattress set.
Figure 1B:
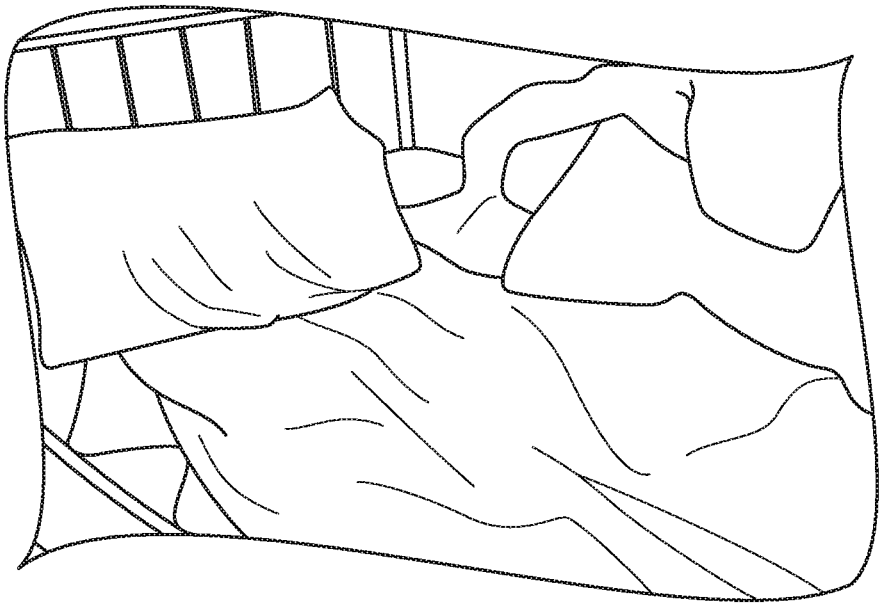
FIG. 1*b* shows a rumpled bedsheet when it is not securely fastened to the mattress.

In referring to FIG. 1*a*, a conventional mattress set 10 is depicted. A mattress set often includes a box-spring 12 at the bottom and a mattress 14 on top. Traditionally, a mattress cover and/or a fitted bedsheet are placed on top of the mattress 14 for protection and comfort. A fitted bedsheet is often fitted with elastic band and used to wrap over the corners of the mattress 14. Elastic bands do not offer strong enough force to hold a fitted bedsheet in place after a night's sleep. A fitted bedsheet often becomes scrunched up as shown in FIG. 1*b*. Means that offers stronger force to hold a bedsheet firmly is available but can make changing bedsheet inconvenient or difficult.

A commercially available product called QuickZip comes with two separate components: a fitted base that is placed on the underside of a mattress and an upper zip-on sheet that is zipped onto the fitted base. The zip-on sheet is firmly held to the fitted base via zipper. So QuickZip makes it convenient to remove the zip-on sheet for wash by simply unzipping the upper portion. However, QuickZip does not work with conventional bedsheets and purchasers of QuickZip cannot reuse the bedsheets they currently own. Also, the upper portion of QuickZip may shrink after multiple washes and it becomes difficult or impossible to zip the upper portion onto the fitted base.

Another commercially available product called SheetLock is simply an elastic band designed to wrap around each end of a mattress to hold a bedsheet in place. SheetLock comes in different sizes that match standard mattress sizes, such as king, queen, full, etc. SheetLock products are not adjustable to fit any mattress size, such as those non-standard ones. SheetLock products are also meant to work with fitted sheet, not flat sheet or duvet cover. Flat sheets and duvet covers still need to be tucked under the mattress 14.

The bedsheet fastener disclosed herein provides a simple and economic way to keep bedsheet neat and tight, and also makes it convenient to change bedsheet. The bedsheet fastener disclosed herein can work on any mattress and with any bedsheet or duvet cover, without having to buy custom-made mattress, bed frame or bedsheets. It can be adopted and implemented by all households.

An exemplary bedsheet fastener 100 disclosed herein comprises one or more sets of magnets 102*a*-102*g*. Each set 102 comprises two pieces of magnets, 200 and 300. The first piece 200 is used for being attached to a mattress. The second magnet 300 is attachable to and detachable from the first piece 200. The two pieces of magnets in each set can hold a bedsheet in between and clasp the bedsheet firmly by magnetic force. In some embodiments, the first piece of magnet 200 can be mechanically affixed to the mattress. In some embodiments, the first piece of magnet 200 can be affixed to the mattress via chemically means. For example, the first piece of magnet 200 can be glued to the mattress. Removable adhesive can be used to allow easy and clean removal when the bedsheet fastener needs to be taken off from the mattress.

The one or more sets of magnets can be arranged on a mattress, for example, on the four corners. Each set holds the bedsheet in between the first piece and the second piece of magnets. The magnets provide the holding force needed to keep a bedsheet in place and prevent it from rumpling. Depending on the size of the mattress, multiple sets of magnets can be used. For example, for a twin-size mattress, 4 sets of magnets may be sufficient to provide strong enough holding force. For a king-size mattress, perhaps 8 sets or 12 sets of magnets are needed. Users can always purchase additional sets of magnets if stronger holding force is desirable. The bedsheet fastener 100 disclosed herein can work with any mattress size and any bedding, e.g., fitted bedsheet, top bedsheet, and duvet cover. Unpackaged or naked magnets or magnetic strips can be used. However, for ease of handling and for protection, magnets may be housed within panels or covered in protective overlay or sheath. In the following sections, different embodiments of covers or sheaths are described as magnet containers.

Figure 3:
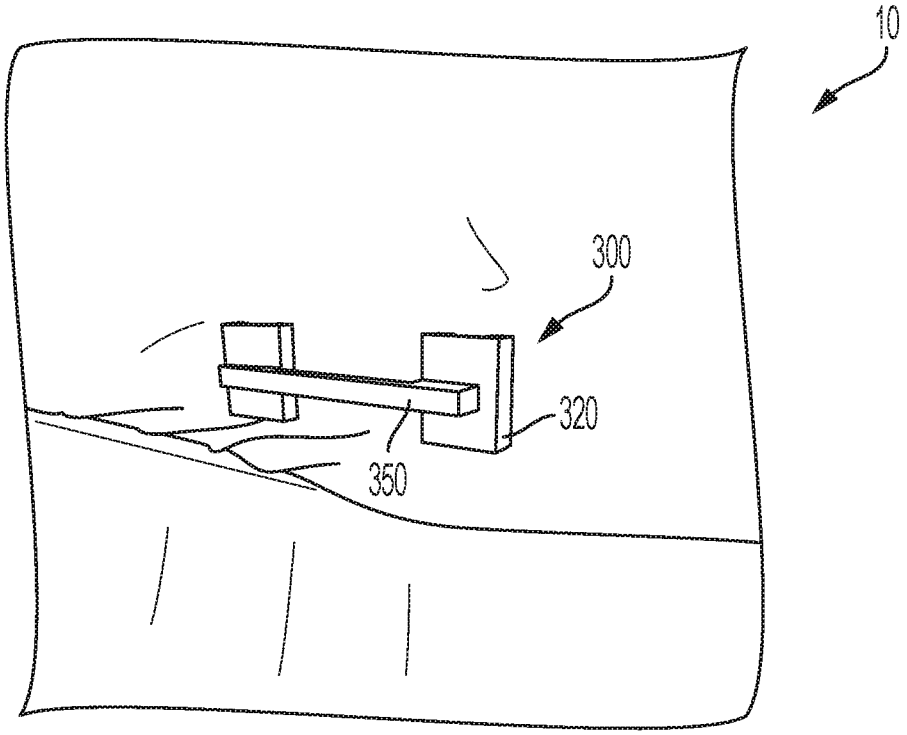
FIG. 3 illustrates an exemplary embodiment of the bedsheet fastener holding a bedsheet in place.

FIG. 3 illustrates an exemplary bedsheet fastener 100 used on a mattress 10. The bedsheet fastener 100 holds a bedsheet. Only one set of magnets is shown in FIG. 3. Each set of magnets of the bedsheet fastener comprises two pieces of magnet, 200 and 300. The first piece 200 (hidden behind the bedsheet in FIG. 3, shown in FIG. 4) is affixed to the mattress. The second piece of magnet 300, which is visible in FIG. 3, is attachable to the first piece of magnet 200 via magnetic force and detachable from the first piece 200. Magnets or magnetic strips are housed in the two squares 320 at the two ends of the second piece 300. The second piece of magnet 300 also includes a handle 350 for handling by hand.

Figure 4:
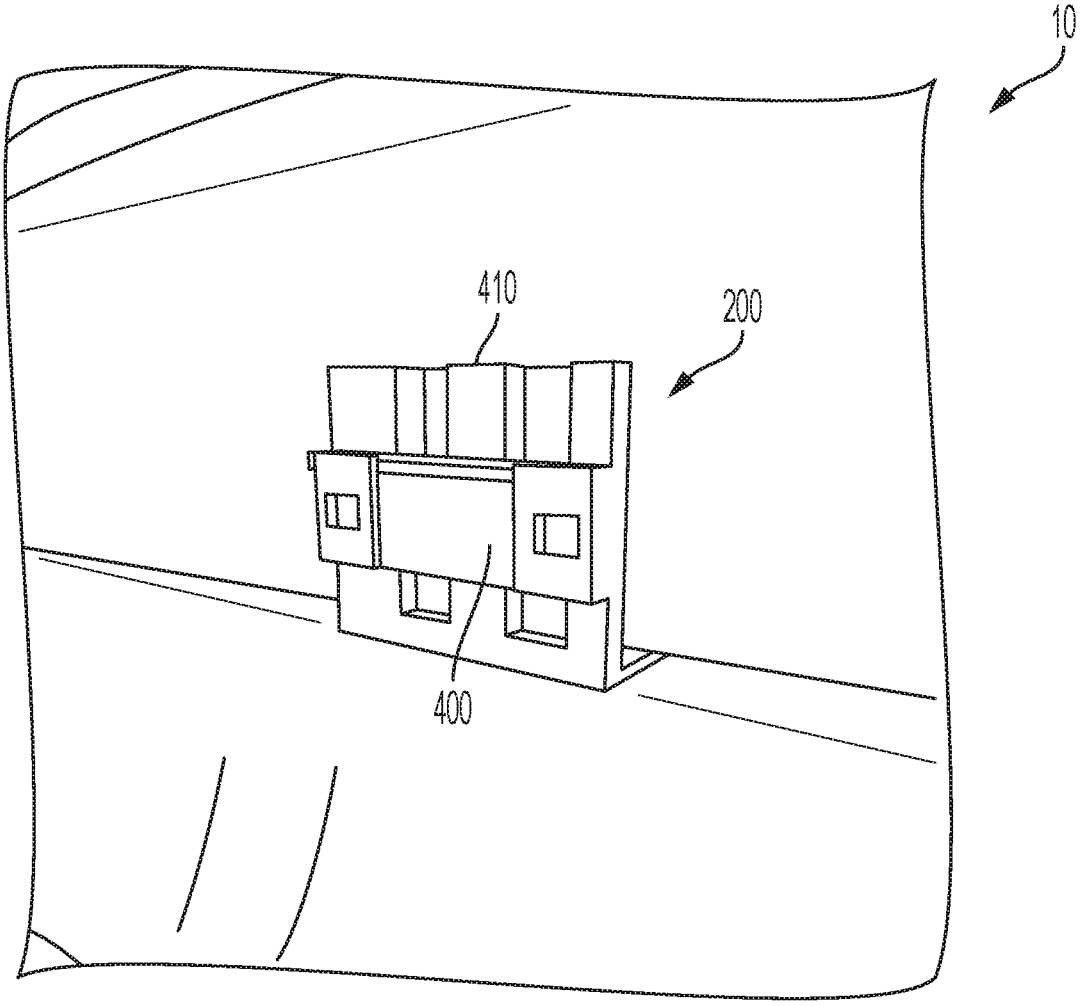
FIG. 4 illustrates a first piece of magnet in an exemplary embodiment of the bedsheet fastener that is attached to the mattress.

FIG. 4 illustrates an exemplary first piece magnet 200 of the bedsheet fastener 100. In FIG. 4, the first piece 200 is shown to comprise two components, an insert 410 and a panel 400. The insert 410 is mechanically affixed to the mattress set 10 and will be explained in more details in FIG. 5. The panel 400 is attached to the insert 410 and houses magnets or magnetic strips inside. The panel 400 matches the second piece 300 (shown in FIG. 3) in size and in configuration. In both the panel 400 and the second piece 300, magnets or magnetic strips are placed near the ends to enhance the magnetic force between the first piece 200 and the second piece 300 when they are attached together. The second piece 300 has a handle for ease of handling by hand. The second piece 300 can be attached to or detached from the first piece 200 by hand. The panel 400 can be attached to or detached from the inset 410 by hand.

Figure 5:
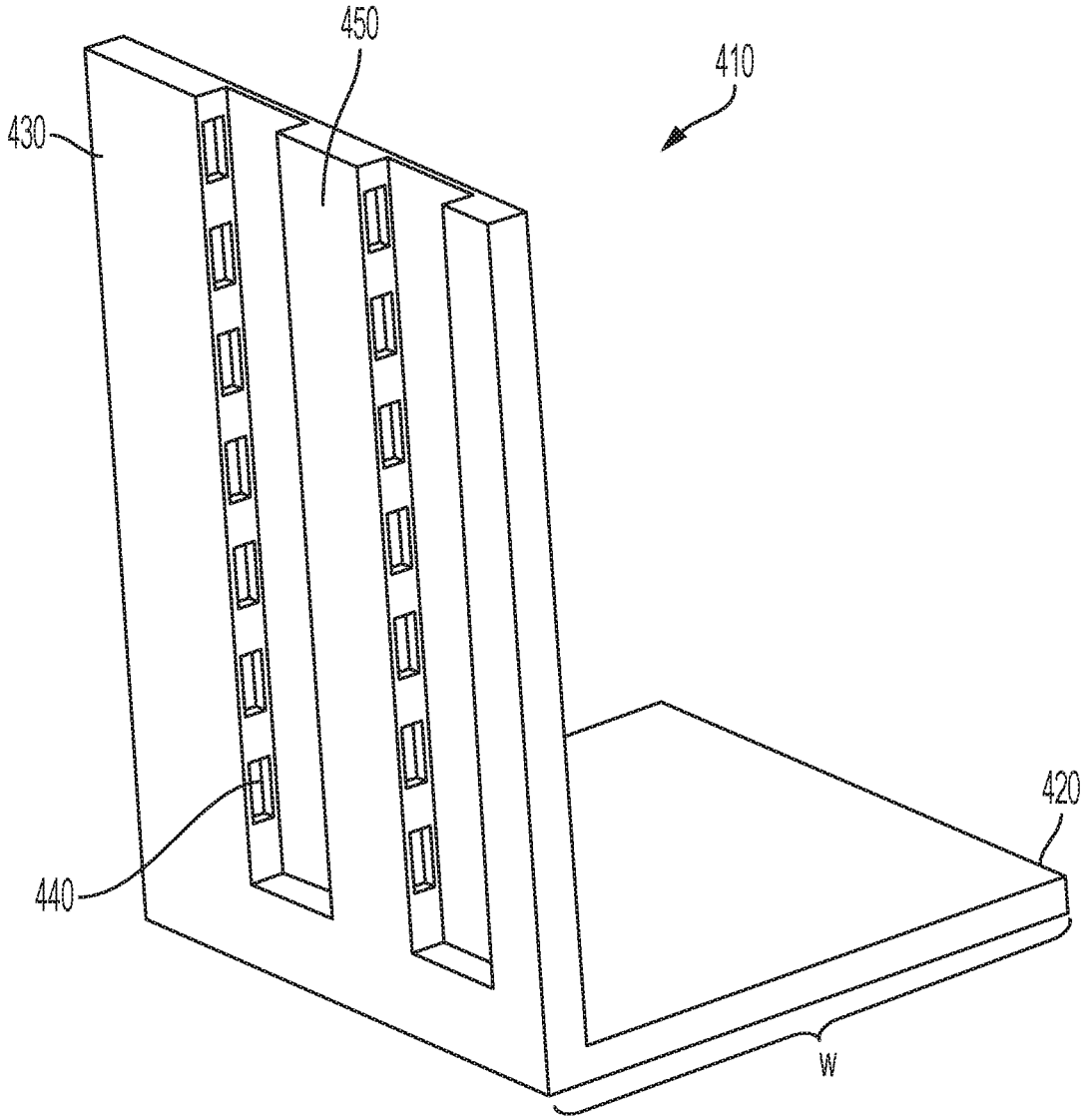
FIG. 5 illustrates an exemplary insert of the bedsheet fastener affixed to the mattress.
Figure 6:
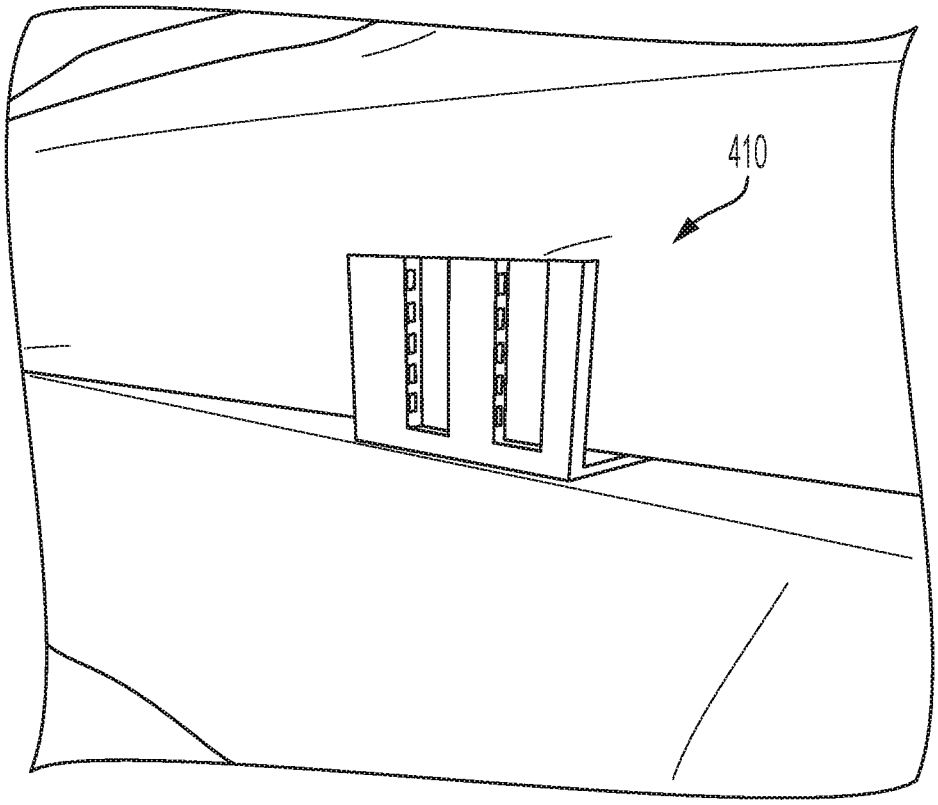
FIG. 6 illustrates an exemplary insert of the bedsheet fastener.

The details of the insert 410 are illustrated in FIG. 5 and FIG. 6. The exemplary insert 410 depicted in FIG. 5 comprises a base 420 and a pane 430. The base 420 is flat and horizontal. The base 420 is to be inserted in between the mattress 12 and the box spring 14 when in use. The base 420 has a relatively large width, w, so that the base 420 does not slip off the mattress 12. The pane 430 is vertical and is attached to the base 420. When the base 420 is inserted in between the mattress 12 and the box spring 14, the pane 430 sits straight against the side of the mattress 12, as shown in FIG. 6.

In FIG. 6, the insert 410 is tucked in between the mattress 12 and the box spring 14. The weight of the mattress 12 sits on top of the base 420 and firmly holds the insert 410 in place.

Figure 7:
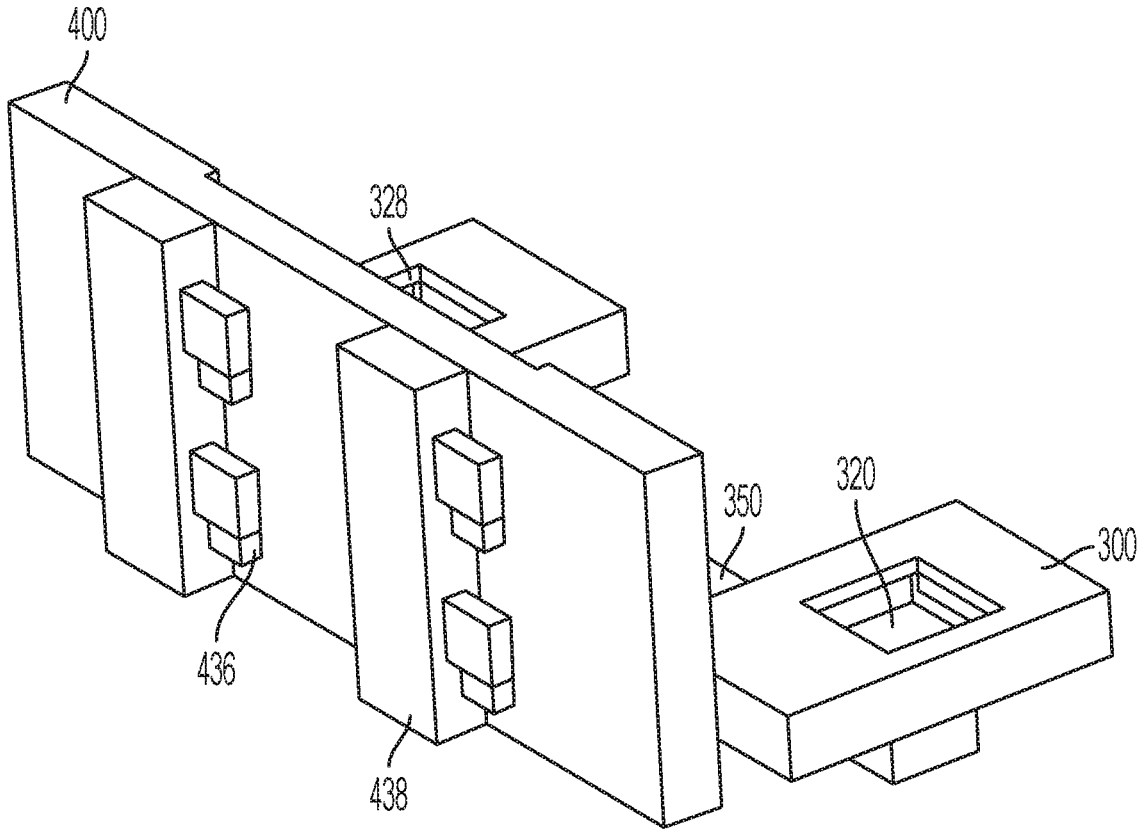
FIG. 7 illustrates panels used in an exemplary embodiment of the bedsheet fastener.
Figure 8:
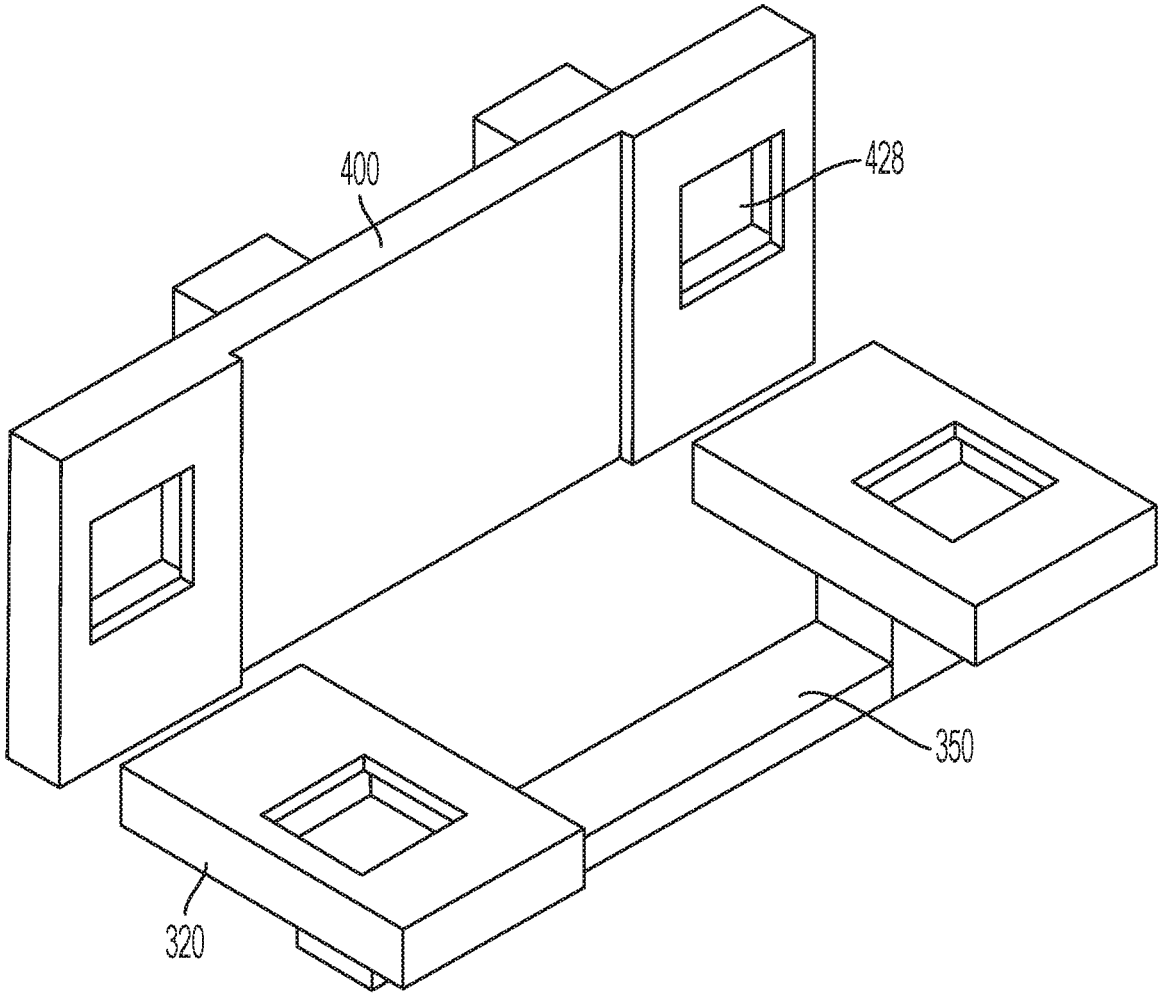
FIG. 8 illustrates exemplary panels used in the bedsheet fastener.

The exemplary pane 430 in the bedsheet fastener embodiment shown in FIG. 5 comprises multiple vertical ribs 450. On both sides of each vertical rib 450, there are an array of cutouts or holes 440, The array of cutouts or holes 440 is used for receiving the panel 400. The structure of the panel 400 is illustrated in FIG. 7 and FIG. 8.

In some embodiments, the panel 400 and the second piece 300 in the shape of a panel have similar structures. FIG. 7 and FIG. 8 show two panels having matching configuration. In FIG. 7, the panel 300 comprises two end squares 320 and a handle 350 connecting the two end squares 320. On each of the end squares 320, there is an indentation or recess 328. A magnet or magnetic strip can be placed into the recess 328. Glue or adhesive can be used to attach the magnet onto the wall of the recess 328. In some embodiments, more than one recess may be cut out or formed on each of the end squares 320. The panel 400 is configured with two recesses 428 (not shown in FIG. 7) that match the recesses 328 on the panel 300, as shown in FIG. 8. The two recesses 428 are formed on the front side of the panel 400. On the back side of the panel 400, there are multiple ribs 438 that are vertically arranged. On each side of the ribs 438, multiple notches 436 are arranged similarly to the array of cutouts or holes 440 on the vertical pane 430. The notches 436 can be inserted into the cutouts 440 when the panel 400 is attached to the pane 430. The height at which the panel 400 is attached to the panel 430 is adjustable by using different cutouts on the vertical pane 430.

Figure 2:
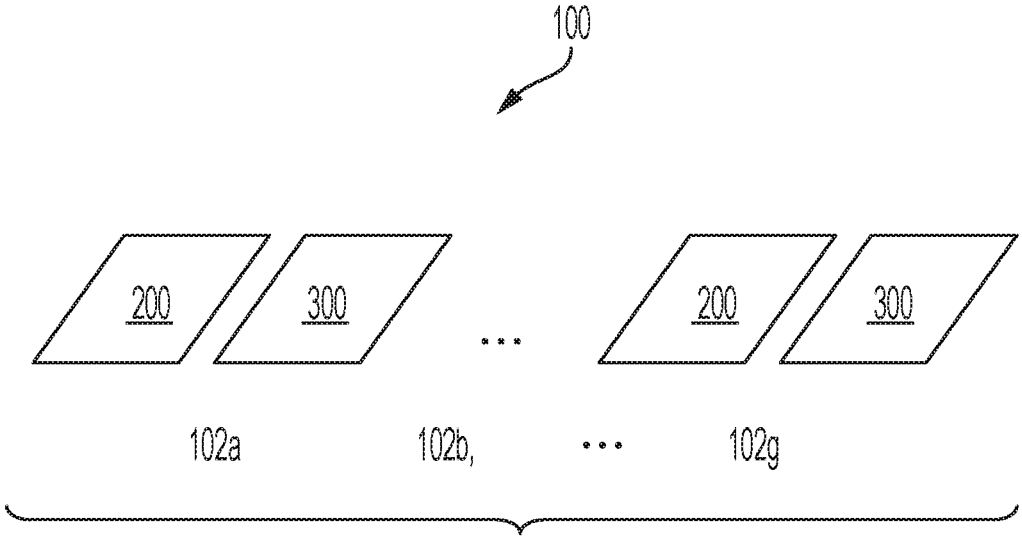
FIG. 2 illustrates an exemplary bedsheet fastener 100.

The first piece magnet 200 in each set of magnets (see FIG. 2) can be affixed to a mattress set 10 via different means, e.g., mechanical or chemical means. In the embodiments described above, the first piece magnet 200 is affixed to the mattress set 10 mechanically. The first piece magnet 200 can also be affixed to the mattress via chemical means. For instance, the first piece 200 may be glued onto the mattress via removable adhesive. Removable adhesive does not leave residue on the mattress and does not damage the mattress, which makes it an ideal means to attach the first piece 200 to the mattress.

The bedsheet fastener 100 disclosed herein can be made of any suitable materials. For example, plastics, cardboard, metal, resin, etc. In some embodiments, each set of the bedsheet fastener 100 may comprise one piece of magnet and one piece of metal. For example, when the insert 410 is made of metal, the panel 300, which houses magnets, are attachable to and detachable from the insert 410 due to the magnetic force between the metal inset 410 and the magnets housed in the panel 300. In this case, there is no need to use magnets in the insert 410. For another example, when the panel 300 is made of metal, the panel 300 is attachable to and detachable from the insert 410 that houses magnet. In some embodiments, magnets are still used in the metallic insert 410 or metallic panel 300 to enhance the magnetic force.

Although the disclosure is illustrated and described herein with reference to specific embodiments, the disclosure is not intended to be limited to the details shown. Rather, various modifications may be made in the details within the scope and range of equivalents of the claims and without departing from the disclosure.

What is claimed is:

1. A bedsheet fastener comprising a plurality sets of magnets, wherein each set of magnets comprises:

two or more first pieces of magnet, said first pieces of magnet configured to be affixed to a mattress; and two or more second pieces of magnet, wherein the number of first pieces of magnet is the same as the number of second pieces of magnet, wherein said second pieces of magnet are attachable to and detachable from the corresponding first pieces of magnet;

wherein the plurality sets of magnets are arranged around the mattress, wherein the plurality sets of magnets are configured to hold a bedsheet in place by clasping the bedsheet in between the first pieces and second pieces of magnet of each set of magnets; and wherein the number of sets in the plurality sets of magnets is adjustable-according to a size of the mattress;

wherein, for each set of magnets, the first pieces of magnet are located on an insert affixed to the mattress and the second pieces of magnet are located on a panel that has a handle for easy handling by hand, and wherein the insert and the panel have matching indentations that contain the first pieces of magnet and the second pieces of magnet respectively.

2. The bedsheet fastener of claim 1, wherein the number of two or more first pieces of magnet and the number of two or more second pieces of magnet are adjustable.

3. The bedsheet fastener of claim 1, wherein the insert in each set of magnets is affixed to the mattress via mechanical or chemical means.

4. An apparatus for fastening a bedsheet to a mattress, comprising:

an insert that comprises a vertical panel and a base, wherein said vertical panel is configured to hold a panel, said panel comprises one or more pieces of magnets and wherein said base is configured to be placed underneath the mattress; and an attachment panel configured to hold one or more pieces of magnets;

wherein the panel is configured with notches wherein the attachment panel is attachable to the vertical panel via magnets to secure the bedsheet in between the attachment panel and the vertical panel and wherein the attachment panel is detachable from the insert to release the bedsheet;

wherein the vertical panel is configured with multiple ribs, with each rib having an array of holes arranged vertically for receiving the notches of the panel; and wherein the panel is mounted on the vertical panel into selected holes on the multiple ribs at an adjustable height.

5. The apparatus of claim 4, wherein the attachment panel and the panel have one or more hollow portions arranged at matching locations, each of said hollow portions holding a piece of magnet.

6. The apparatus of claim 4, wherein the attachment panel and the panel have one or more inner pockets arranged at matching locations, each of said inner pocket holding a piece of magnet.

7. The apparatus of claim 4, wherein the apparatus is made of plastic, cardboard, or wood.

8. An apparatus for fastening a bedsheet to a mattress, comprising:

an insert comprising a vertical panel and a base, wherein said base is configured to be placed underneath the mattress and wherein said vertical panel is connected to the base;

an attachment panel, wherein the attachment panel is attachable to the insert via magnet to secure the bedsheet in between the attachment panel and the vertical panel and is detachable from the insert to release the bedsheet; and a panel configured with notches;

wherein the vertical panel is configured with multiple ribs, with each rib having an array of holes arranged vertically for receiving the notches of the panel; and wherein the panel is mounted on the vertical panel into selected holes on the multiple ribs at an adjustable height.

9. The apparatus of claim 8, wherein the vertical panel of the insert is made of metal and the attachment panel holds one or more pieces of magnet.

10. The apparatus of claim 8, wherein the attachment panel is made of metal and the vertical panel holds one or more pieces of magnet.

11. The apparatus of claim 8, wherein the attachment panel further comprises a handle for holding by hand.

* * * * *